US005151106A

United States Patent [19]

Bhaumik et al.

[11] Patent Number: 5,151,106

[45] Date of Patent: Sep. 29, 1992

[54] METHOD FOR TINTING A HYDROPHILIC POLYMER BY INCORPORATING A REACTIVE DYE INTO THE POLYMER PRIOR TO POLYMERIZATION

[75] Inventors: Debabrata Bhaumik, New York, N.Y.; Patrick K. Chen, Edison, N.J.

[73] Assignee: Allergan, Inc., Irvine, Calif.

[21] Appl. No.: 632,466

[22] Filed: Dec. 21, 1990

[51] Int. Cl.[5] ..... D06P 5/00

[52] U.S. Cl. ..... 8/507; 8/509; 8/543; 8/549; 351/162; 525/329.5; 525/375

[58] Field of Search ..... 8/507, 509, 549, 543; 351/162; 525/375, 329.5

[56] References Cited

U.S. PATENT DOCUMENTS

| | | | |
|---|---|---|---|
| 3,476,499 | 11/1969 | Wichterle | 8/507 |
| 3,679,504 | 7/1972 | Wichterle | 351/162 |
| 3,940,377 | 2/1976 | Horowitz et al. | 525/375 |
| 4,123,407 | 10/1978 | Gordon | 260/29.6 TA |
| 4,157,892 | 6/1979 | Tanaka et al. | 8/14 |
| 4,182,612 | 1/1980 | Sokol et al. | 525/375 |
| 4,252,421 | 2/1981 | Foley, Jr. | 351/162 |
| 4,447,474 | 5/1984 | Neefe | 8/507 |
| 4,468,229 | 8/1984 | Su | 8/507 |
| 4,494,954 | 1/1985 | Suminoe et al. | 8/509 |
| 4,517,139 | 5/1985 | Rawling et al. | 264/2.1 |
| 4,517,140 | 5/1985 | Rawlings | 264/2.1 |
| 4,553,975 | 11/1985 | Su | 8/507 |
| 4,559,059 | 12/1985 | Su | 8/507 |
| 4,582,402 | 4/1986 | Knapp | 351/162 |
| 4,615,593 | 10/1986 | Neefe | 8/507 |
| 4,634,449 | 1/1987 | Jenkins | 8/507 |
| 4,640,805 | 2/1987 | Neefe | 8/507 |
| 4,659,522 | 4/1987 | Neefe | 8/507 |
| 4,668,240 | 5/1987 | Loshaek | 8/507 |
| 4,701,038 | 10/1987 | Neefe | 351/162 |
| 4,746,691 | 5/1988 | Fuhrman | 351/162 |
| 4,891,046 | 1/1990 | Wittmann et al. | 8/507 |
| 4,929,685 | 5/1990 | Kobashi et al. | 525/375 |
| 4,946,269 | 8/1990 | Magdassi | 351/162 |
| 4,954,132 | 9/1990 | Hung et al. | 8/507 |
| 4,997,897 | 3/1991 | Melpolder | 351/162 |
| 5,030,697 | 7/1991 | Hugl et al. | 525/375 |

FOREIGN PATENT DOCUMENTS

| | | |
|---|---|---|
| 0122771 | 10/1984 | European Pat. Off. . |
| 53-97064 | 8/1978 | Japan . |
| 53-99279 | 8/1978 | Japan . |
| 1583492 | 1/1981 | United Kingdom . |

*Primary Examiner*—Paul Lieberman
*Assistant Examiner*—Bradley A. Swope
*Attorney, Agent, or Firm*—Dilworth & Barrese

[57] ABSTRACT

A hydrophilic polymer, e.g., provided as a contact lens, is tinted by a method which incorporates a reactive dye into the polymer during formation of the latter. Following physical entrainment of the reactive dye in the polymer, the polymer is contacted with an aqueous solution of a base which catalyzes the reaction of the dye with the polymer. In this way, the dye becomes permanently covalently bound to the polymer.

26 Claims, No Drawings

METHOD FOR TINTING A HYDROPHILIC POLYMER BY INCORPORATING A REACTIVE DYE INTO THE POLYMER PRIOR TO POLYMERIZATION

BACKGROUND OF THE INVENTION

This invention relates to a method for tinting a hydrophilic polymer employing a reactive dye.

Contact lenses of the "soft" variety are generally formed from covalently crosslinked hydrophilic polymers which are based on hydrophilic derivatives of acrylic or methacrylic acid, e.g., their hydrophilic esters or amides, hydrophilic vinylic polymers such as vinylpyrrolidone, and the like. In their hydrated state, these polymers are referred to as hydrogels, coherent three-dimensional polymer structures or networks which are capable of absorbing large quantities of water without dissolving and of transporting oxygen. In addition to hydrophilic monomer(s), the preparation of hydrophilic polymers used in the manufacture of soft contact lenses also utilizes minor amounts of less hydrophilic, and even hydrophobic, monomer(s) to confer mechanical strength and other useful properties.

Contact lenses formed from hydrophilic polymers can be tinted for cosmetic appearance as well as to reduce light transmission thereby providing the wearer with greater visual comfort. A variety of methods have been disclosed for tinting such lenses. According to U.S. Pat. No. 4,891,046, the contents of which are incorporated by reference herein, a hydrophilic contact lens is tinted with a dichlorotriazine dye in a two step procedure. In the first step of the procedure, the lens, which is formed from a hydrophilic polymer obtained by the peroxide-initiated polymerization of a polymer-forming composition containing a hydroxyl group-containing acrylic ester monomer, e.g., hydroxyethyl methacrylate (HEMA), and N-vinylpyrrolidone, is immersed in an aqueous solution of dichlorotriazine dye maintained at an approximately neutral pH which reduces to near zero the rate at which the dye hydrolyzes or reacts with the hydroxyl groups of the acrylic ester monomer. Under these conditions, the dye diffuses into the lens. Thereafter, the dye-impregnated lens is immersed in an aqueous solution of base which catalyzes the reaction of the dye with the hydroxyl groups in the polymer backbone.

The hydrophilic contact lens tinting method of U.S. Pat. No. 4,891,046 is intended to be practiced on a finished lens and incorporates the dichlorotriazine dye in the hydrophilic polymer constituting the lens body in an operation which is entirely distinct from that used for forming the polymer.

SUMMARY OF THE INVENTION

It is an object of the invention to provide a method for tinting a hydrophilic polymer with a reactive dye.

It is a particular object of the invention to provide a method for tinting a contact lens fabricated from a hydrophilic polymer in which a reactive dye is incorporated in the hydrophilic polymer during its formation.

It is yet another object of the invention to manufacture a tinted hydrophilic contact lens from a hydrophilic polymer-forming composition which includes a reactive dye and a polymerization initiator other than a peroxide under spin casting conditions whereby the lens is simultaneously formed and the dye incorporated therein and subsequently hydrating the lens in an aqueous solution of base which catalyzes the reaction of the dye with the polymer.

In keeping with these and other objects of the invention, a method is provided for tinting a hydrophilic polymer which comprises:

a) subjecting a hydrophilic polymer-forming composition comprising (i) at least one hydrophilic ethylenically unsaturated monomer, (ii) a reactive dye and (iii) a polymerization initiator which does not chemically affect the reactive dye to polymer forming conditions to provide a hydrophilic polymer in which the reactive dye is substantially uniformly incorporated therein; and, b) contacting the polymer with an aqueous solution of a base which catalyzes the reaction between the polymer and the reactive dye, the reactive dye thereby becoming covalently bound to the polymer.

Unlike the tinting method of U.S. Pat. No. 4,891,046, supra, the reactive dye employed in the tinting method of this invention is incorporated into a hydrophilic polymer while the polymer is being formed. Thus, the present tinting method obviates the need for a separate manufacturing operation wherein a pre-formed hydrophilic polymer is immersed in an aqueous solution of reactive dye.

DESCRIPTION OF THE PREFERRED EMBODIMENTS

Hydrophilic polymers which can be tinted by the method of this invention constitute a well-known class of synthetic resins derived from a polymerizable ethylenically unsaturated hydrophilic monomer, usually with one or more other comonomers and with a crosslinking monomer as described, inter alia, in U.S. Pat. Nos. 2,976,576; 3,220,960; 3,822,089; 4,123,407; 4,208,364; 4,208,365; and, 4,517,139, the contents of which are incorporated by reference herein. Suitable hydrophilic monomers include hydroxy lower alkyl acrylates or methacrylates, hydroxy lower alkoxy lower alkyl acrylates or methacrylates, and alkoxy lower alkyl acrylates or methacrylates. A "lower alkyl" or "lower alkoxy" is herein defined to mean an alkyl or alkoxy of about five carbon atoms or less. Specific hydrophilic monomers include hydroxyethyl methacrylate (HEMA), hydroxyethyl acrylate, hydroxypropyl methacrylate, hydroxypropyl acrylate, butanediol monomethacrylate monoacrylate and vinylpyrrolidone. The hydroxyalkyl acrylates and methacrylates, particularly 2-hydroxyethyl methacrylate are generally preferred.

Useful comonomers generally included in the polymer-forming composition include the alkyl acrylates or methacrylates such as methyl methacrylate, ethyl acrylate, isopropyl acrylate, propyl acrylate, butyl acrylate, secbutyl acrylate, pentyl acrylate, 2-ethylhexyl acrylate, methyl methacrylate, ethyl methacrylate, propyl methacrylate, isopropyl methacrylate, butyl methacrylate, sec-butyl methacrylate, pentyl methacrylate, cyclohexyl methacrylate and fluorinated acrylates and methacrylates. Examples of aryl acrylates and methacrylates are phenyl acrylate, phenyl methacrylate, etc. An example of an alkyl or aryl vinyl ether is ethyl vinyl ether and phenyl vinyl ether.

While the hydrophilic polymers can be crosslinked by exposure to energy, e.g., heat or actinic radiation, the more common practice is to achieve covalent crosslinking through the use of a diethylenically unsaturated crosslinking monomer. Examples of such crosslinking monomers include diethylene glycol dimethacrylate, triethylene glycol dimethacrylate, tetraethylene glycol dimethacrylate, polyethylene glycol dimethacrylate, butylene glycol dimethacrylate, neopentyl glycol dimethacrylate, diethylene glycol bisallylcarbonate, 2,3-epoxy propyl methacrylate, divinyl benzene, ethylene glycol diacrylate, ethylene glycol dimethacrylate, 1,3-butylene dimethacrylate, 1,3-butylene dimethacrylate, 1,4-butylene dimethacrylate, propylene glycol diacrylate, propylene glycol dimethacrylate, dipropylene glycol dimethacrylate, diethylene glycol diacrylate, dipropylene glycol diacrylate and trimethylol propane trimethacrylate.

Where the hydrophilic polymer is intended to be used in the manufacture of a contact lens, the polymer-forming composition will typically contain from about 50 to about 95 weight percent hydrophilic monomer, from about 1 to about 40 weight percent comonomer and from about 0.2 to about 2.5 weight percent crosslinking monomer.

The polymerization initiator selected for inclusion in the hydrophilic polymer-forming composition must be non-reactive for the reactive dye component. This requirement necessarily excludes the peroxide-type polymerization initiators which oxidize (bleach) reactive dyes. Photoinitiators constitute one class of useful polymerization initiator which, unlike the peroxides, do not affect the reactive dye. Photoinitiators are well known and are described, e.g., in Chapter II of "Photochemistry" by Calvert and Pitts, John Wiley & Sons (1966). The preferred photoinitiators are those which facilitate polymerization when the polymer-forming composition is irradiated with UV light. Representative examples of such initiators include azo type compounds such as azobisisobutyronitrile, 2,2'-azobis-(2,4-dimethylvaleronitrile) and 2,2'-azobis-(2,4-dimethyl-4-methoxyvaleronitrile), acyloin and derivatives thereof such as benzoin, benzoin methyl ether, n-benzoin ethyl ether, benzoin isopropyl ether, benzoin isobutyl ether and α-methylbenzoin; diketones such as benzil and diacetyl, etc.; ketones such as acetophenone, α, α, α-trichloroacetophenone, α, α, α-tribromoacetophenone, α, α-diethoxyacetophenone DEAP), 2-hydroxy-2-methyl-1-phenyl-1-propanone, o-nitro-α, α, α-tribromoacetophenone, benzophenone and p,p'-tetramethyldiaminobenzophenone; α-acyloxime esters such as benzil-(O-ethoxycarbonyl)-α-monoxime; ketone/amine combinations such as benzophenone/N-methyldiethanolamine, benzophenone/tributylamine and benzophenone/Michler's ketone; and benzilketals such as benzildimethylketal, benzildiethylketal and 2,5-dichlorobenzildimethylketal. Preferably, from about 0.25 to about 1.0% of photoinitiator is present in the polymer-forming composition.

Useful reactive dyes for inclusion in the hydrophilic polymer-forming composition are commonly characterized as "reactive dyes forming ether linkages" in as much as the reactive group or groups in this known class of dyes react with cellulose to form an ether linkage as opposed to, for example, an ester linkage. Such reactive dyes forming ether linkages are generally described in FIBRE-REACTIVE DYES Chapter VI, by W. F. Beech, SAF International Inc., New York (1970), incorporated herein by reference.

This class of reactive dyes are believed to react with hydroxyl, amino, amido or mercapto groups present in the hydrophilic polymer network primarily by nucleophilic addition to form a covalent bond therewith.

A wide variety of commercially available dyes, reactive via nucleophilic substitution, are suitable for use herein. In addition, virtually any desired shade or tint can be achieved through the use of a particular reactive dye or combination of reactive dyes.

Thus, dyes containing an activated double bond which is able to add to a functional group external to the polymer backbone can be used. Exoskeletal bonds activated by a bridge member such as an $—SO_2—$, —SO— or —CO— group are particularly suitable for use according to the invention. Similarly, dyes with functional groups which can undergo addition reactions with exoskeletal double bonds of the polymer can be employed.

Among the types of reactive dyes suitable for use according to the invention, the following general classes may be mentioned: reactive dyes containing vinyl sulfone precursors, such as β-sulfatoethylsulfonyl, β-sulfatoethylsulfonamido, β-hydroxyethylsulfonyl and β-hydroxyethylsulfonamido substituents, as well as suitable derivatives thereof; dyes containing acryloylamino, β-chloropropionylamino, and β-sulfatopropionylamino and related reactive groups; dyes containing β-sulfato- or β-chloroethylsulfamoyl groups; chloroacetyl dyes; α-bromoacryloyl dyestuffs; and a wide variety of other reactive dyes which have or are being developed for use in the dyeing of natural and synthetic fibers, in particular of cellulose and wool and function by nucleophilic addition.

Also suitable are dyes capable of forming a covalent bond with hydroxyl, amino, amido or mercapto groups present in one or more components of the polymer-forming composition having the general formula

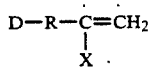

or

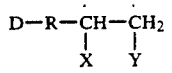

wherein

D is the radical of an organic dyestuff radical;

R is a divalent organic electron attracting group capable of causing electron withdrawal of the C carbon atoms, thus activating the same;

X is hydrogen or halo; and

Y is a leaving group; or mixtures thereof.

The radical D may advantageously be the radical of an azo, phthalocyanine, azomethine, nitro or anthraquinone dye.

The divalent group —R— is advantageously bonded directly to an aromatic nuclear carbon of D, or is bonded thereto via an aliphatic group such as an alkylene group, e.g., a lower alkylene group. Most preferably, —R— is directly bonded to a nuclear carbon atom of D.

Suitable divalent R groups include —CO—, $—SO_2—$, —SO—, —NHCO—, $—NHSO_2—$, $—SO_2NH—$ and the like. Most preferably, —R— is $—SO_2—$, $—SO_2NH—$, —CO— or —NHCO—.

When X is halo, it is most preferably chloro or bromo.

Suitable leaving groups, Y include —Cl, —Br, —OH, di-lower alkylamino,

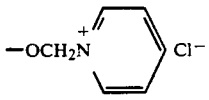

—$SO_2$—phenyl, —$OSO_3$—Z+ where Z is a cation, —O—$SO_3R_1$ or —$OSO_2R_1$ where $R_1$ in each case is alkyl, aryl, aralkyl or alkaryl.

Advantageously where $R_1$ is alkyl, it is an alkyl of from 1 to 6 carbon atoms, preferably of 1 to 4 carbons, including, for example, methyl, ethyl, isopropyl, butyl and the like. Where $R_1$ is aryl, it is preferably phenyl or naphthyl. Where $R_1$ is aralkyl, it is preferably lower alkyl substituted phenyl such as tolyl or xylyl and where $R_1$ is alkaryl, it is preferably lower alkylenephenyl such as benzyl or phenethyl.

The dichlorotriazine dyes, i.e., those corresponding to the general formula

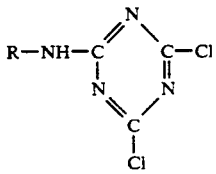

wherein R represents a chromophore radical are preferred for use in the tinting method of this invention. The chromophore radical of the reactive dichlorotriazine dye may be any radical which is not incompatible with the dichlorotriazine nucleus and has an appropriate absorption spectrum. Thus dye radicals of the azo, metallized-azo, anthraquinone, phthalocyanine complex and metal-complexed formazon types are suitable.

Suitable dichlorotriazine reactive dyes include Color Index (CI) Reactive Blue 140, CI Reactive Blue 163, CI Reactive Blue 109, CI Reactive Blue 4, CI Reactive Yellow 86, CI Reactive Yellow 7, Procion Yellow M4RF, Procion Yellow MX-2GA, CI Reactive Orange 4, Procion Orange MX-G, CI Reactive Red 11, CI Reactive Red 1, CI Reactive Red 2, CI Reactive Red 6, and Procion Black MX-CWA. Particularly preferred dichlorotriazine dyes include CI Reactive Blue 163, CI Reactive Red 2, CI Reactive Red 11, CI Reactive Blue 140, CI Reactive Yellow 86 and Procion Black MX-CWA.

The dichlorotriazine dyes are the most reactive of the available reactive dyes as determined by comparative dyeing of cellulose. This allows the use of lower temperatures and lower pH to effect a reaction.

The amount of dye present in the hydrophilic polymer-forming composition can vary considerably with amounts ranging from about 0.010 to about 0.1, and preferably from about 0.03 to about 0.08, weight percent providing generally good results.

Polymerization of the dye-containing hydrophilic polymer-forming composition can be carried out in bulk with the resulting polymer being cut into lens blanks, or "buttons", the buttons then being machined (lathed) to provide contact lenses of the desired optical specifications. For further details, see, e.g., U.S. Pat. No. 3,361,858. Another technique involves molding a contact lens from the hydrophilic polymer-forming composition in a two-piece lens mold as described, e.g., in U.S. Pat. No. 4,121,896. It is preferred, however to prepare contact lenses from the polymer-forming composition employing the spin casting technique. In accordance with this technique, the dye-containing polymer-forming composition is introduced into a mold having a cylindrical wall and an exposed concave bottom surface and the mold is caused to rotate about its vertical axis at a rotational speed and under polymerization conditions sufficient to create a centrifugal force which causes a radially outward displacement of the contents of the mold. By maintaining the rotating mold under predetermined conditions, the outwardly displaced polymerizable material is caused to polymerize to a solid polymeric contact lens. The resulting lens is characterized by a convex optical surface which corresponds to the concave surface of the mold and a concave optical surface whose geometric configuration has been precisely defined, to a significant degree, by the centrifugal force(s) employed during the polymerization cycle.

In one type of spin casting procedure, a plurality of individual molds, each containing a precisely measured quantity of dye-containing polymer-forming composition including a photoinitiator such as any of those previously mentioned, is arranged in a vertically disposed rotatable polymerization tube adapted to receive the molds at its upper end. As the molds which are seated one on top of the other move downwardly through the tube due to their own weight, they pass while spinning through a zone of irradiation, e.g., ultraviolet light, and emerge from the bottom of the tube with the lens in each mold fully formed. Following irradiation, the lenses within their molds can be heated if necessary or desired to complete the polymerization. Suitable apparatus and techniques for practicing this type of spin casting operation are described in U.S. Pat. Nos. 4,468,184; 4,516,924; 4,517,138; 4,517,139; 4,517,140; and, 4,680,149, the contents of which are incorporated by reference herein.

Whichever polymerization procedure is used, the resulting hydrophilic polymer (and any article formed therefrom, e.g., a contact lens) will contain the reactive dye substantially uniformly entrained therein. In order to covalently bond the dye to the polymer backbone, the polymer is contacted with a basic fixing solution, generally heated to a temperature of from about 50° C. and preferably from about 80° C. The basic fixing solution will ordinarily possess a pH of greater than about 8.0 but generally will not exceed about 12.0. Any water-soluble base can be used as the pH adjusting ingredient in the basic aqueous fixing solution, sodium bicarbonate and/or sodium carbonate being preferred. Contact times on the order of from a few seconds to a few minutes are generally sufficient to permanently fix the dye in the polymer through the formation of covalent bonds. Following the fixation step, the tinted hydrophilic polymer can be immersed in an aqueous bath at elevated temperature to remove unreacted dye.

The following examples are illustrative of the hydrophilic-polymer tinting method of the present invention.

EXAMPLE 1

This example illustrates the tinting method of the invention carried out upon a hydrophilic contact lens formed by spin casting.

The following monomer mixture was prepared:

| Component | Weight Percent |
|---|---|
| HEMA | 82.25 |
| Solvent | 15.5 |

-continued

| Component | Weight Percent |
|---|---|
| EDGMA | 0.5 |
| Mold Release Agent | 1.5 |
| Benzoin Methyl Ether (Initiator) | 0.2 |
| Reactive Blue No. 4 (Color Index No. 61205) | 0.05 |

Mixing of the above was conducted within an ice-water bath by agitating for about ½ hour with a magnetic stir bar. The resulting homogeneous solution weighing 10 grams was filtered through a 1 micron filter. The monomer mixture was introduced at a predetermined volume within a range of from 18 to 36 microliters into plastic spin casting molds. The molds were then rotated in a spin casting machine at 300 to 400 rpm, the thickness and the power of the resulting lenses being determined by the volume of monomer mixture and the spin casting parameters. Photopolymerization of the monomer occurred as the initiator became activated by the incident UV light generated by a UV lamp associated with the machine. The average exposure time was 20 -60 seconds.

Each lens, still in its mold, was then immersed in an aqueous solution of 2 weight percent sodium bicarbonate and 1 weight percent buffer solute made of di- and tri-sodium phosphates. The solution w-as maintained at a pH of 11 2 to 11.5 and a temperature of 80° C. The moderately basic solution catalyzed a rapid reaction between the entrained reactive dye and the polymer constituting the lens body. Subsequent lens swelling and expansion of the plastic mold caused each permanently tinted lens to separate from its mold.

EXAMPLE 2

This example illustrates the tinting method of the invention carried out upon a hydrophilic contact lens formed by casting in a two-piece lens mold.

The following monomer composition was prepared:

| Component | Weight Percent |
|---|---|
| HEMA | 97.52 |
| EDGMA | 1.4 |
| 2,2-azobis(2,4-dimethylvaleronitrile) (initiator) | 1.0 |
| Reactive Blue No. 4 (Color Index No. 61205) | 0.08 |

Mixing of the initiator, the dye and the monomers was obtained by agitating the solution with a magnetic stir bar in an ice-water bath for about ½ hour. The resulting homogeneous colored solution was filtered through a 1 micron filter. 50 microliters of the reactive dye-containing monomer mixture was introduced into the optical side of each of several plastic molds. The base curve side was mated with the optical side to make up each two-piece mold. Polymerization was then conducted at 110° C. for 1 hour after which the molds halves were separated to provide the lens with its permanently entrained dye.

No color bleaching resulted from the polymerization reaction. The lenses were placed in a 2 weight percent $NaHCO_3$ solution maintained at 80° C. for 10 minutes and thereafter autoclaved. Each lens was placed in a vial containing saline solution, the solution remaining clear indicating the absence of any leaching of dye from the lenses. Covalent bonding of the dye to the polymer constituting each lens body was considered complete.

EXAMPLE 3

This example illustrates the tinting method of the invention carried out upon a hydrophilic contact lens machined (lathed) to lens specifications from a "button" of hydrophilic polymer.

The following monomer mixture (50 g) was prepared:

| Component | Weight Percent |
|---|---|
| HEMA | 98.12 |
| EDGMA | 1.4 |
| 2,2-Azobis(2,4-dimethyl-4-methoxy-valeronitrile) polymerization (initiator) | 0.4 |
| Reactive Blue No. 4 (Color Index No. 61205) | 0.08 |

A homogeneously colored solution was obtained by the mixing method described in the previous examples. After filtering through 1 micron filter, the dyed monomer was introduced into a number of small tubes (30×20 mm) to two-thirds their volume. The tubes were sealed with rubber stoppers after being slowly purged with nitrogen for 3 minutes and are maintained at ambient temperature in a water bath, fully immersed, for three days. Solid buttons were formed by slow polymerization at room temperature.

The blue color remained uniform without bleaching. A number of discs were lathe-cut from these buttons and placed in an aqueous solution of 2 weight percent $NaHCO_3$ and maintained therein at 80° C. for about 10 minutes. The discs were then autoclaved twice. No dye bleaching or color fading was observed. Lathe-cut lenses were made from the discs in a wide range of powers.

EXAMPLE 4

This example illustrates the inoperativeness of tinting a hydrophilic polymer when the step of entraining the reactive dye in the polymer during polymerization of the monomer mixture utilizes a peroxide polymerization initiator.

The following monomer mixture (10 g) was prepared:

| Component | Weight Percent |
|---|---|
| HEMA | 97.52 |
| EDGMA | 1.4 |
| bis[4-t-butyl cyclo-hexyl] peroxydicarbonate polymerization (initiator) | 1.0 |
| Reactive Blue No. 4 (Color Index No. 61205) | 0.08 |

A homogeneously colored solution was obtained by the mixing method described in the previous examples. After filtering through 1 micron filter, a 50 microliter volume of the dyed monomer was placed within each of several two-piece molds as described in Example 2. Polymerization was conducted at 110° C. for 1 hour. The molds were then separated to obtain the lenses.

The lenses were lightly brown and the polymer clusters which formed at the mold's rim were dark brown. Color bleaching resulted, apparently as a result of the polymerization. The unused portion of the monomer was maintained inside a vial for a week. It was observed that the blue colored monomer polymerized inside the vial to form a cherry-colored mass. The initiator bleached the dye, the reaction possibly having occurred at room temperature.

What is claimed is:

1. A method for tinting a hydrophilic polymer which comprises:

a) subjecting a hydrophilic polymer-forming composition comprising (i) at least one hydrophilic ethylenically unsaturated monomer, (ii) a reactive dye and (iii) a polymerization initiator which does not chemically affect the reactive dye to polymer forming conditions to provide a hydrophilic polymer in which the reactive dye is substantially uniformly incorporated therein; and, b) contacting the polymer with an aqueous solution of a base which catalyzes the reaction between the polymer and the reactive dye, the reactive dye thereby becoming covalently bound to the polymer.

2. The method of claim 1 wherein the monomer is selected from the group consisting of hydroxy lower alkyl acrylate and hydroxy lower alkyl methacrylate.

3. The method of claim 1 wherein the monomer is hydroxyethyl methacrylate.

4. The method of claim 1 wherein the reactive dye is a dichlorotriazine dye.

5. The method of claim 1 wherein the dichlorotriazine dye is selected from the group consisting of CI Reactive Blue 163, CI Reactive Red 2, CI Reactive Red 11, CI Reactive Blue 140, CI Reactive Yellow 86 and Procion Black MX-CWA.

6. The method of claim 1 wherein the base is selected from the group consisting of sodium bicarbonate and sodium carbonate.

7. The method of claim 1 wherein the hydrophilic polymer is formed into a contact lens by spin casting.

8. The method of claim 1 wherein the hydrophilic polymer before or after contact with the aqueous solution of base is machined to provide a contact lens.

9. The method of claim 1 wherein the hydrophilic polymer is formed into a contact lens by molding in a two-piece mold.

10. The method of claim 1 wherein b) the polymer is contacted with the aqueous solution of the base to catalyze the reaction between the polymer and the reactive dye after (a) formation of the hydrophilic polymer with the reactive dye substantially uniformly incorporated therein, has been completed.

11. The method of claim 1 wherein (ii) the reactive dye is incorporated into (i) the unsaturated monomer prior to polymerization thereof; and (iii) the thus-formed polymer is contacted with the aqueous solution of the base subsequent to the polymerization thereof.

12. The method of claim 1 wherein a lens is formed by (a) polymerization to form the hydrophilic polymer; and (b) the thus-formed lens is subsequently hydrated in the aqueous solution of the base to tint the same.

13. The method of claim 7 wherein (b) the thus-formed lens is subsequently hydrated in the aqueous solution of the base to tint the same.

14. The method of claim 8 wherein (b) the thus-formed lens is subsequently hydrated in the aqueous solution of the base to tint the same.

15. The method of claim 9 wherein (b) the thus-formed lens is subsequently hydrated in the aqueous solution of the base to tint the same.

16. The method of claim 1 wherein pH of the aqueous solution of the base is from about 8.0 to about 12.0.

17. The method of claim 1 wherein the polymer-forming composition comprises (i) from about 50 to about 95 weight percent hydrophilic monomer, from about 1 to about 40 weight percent of a comonomer and from about 0.2 to about 2.5 weight percent of a cross-linking monomer.

18. The method of claim 1 wherein the polymer-forming composition comprises (ii) from about 0.01 to about 0.1 weight percent of the reactive dye.

19. The method of claim 18 wherein the polymer-forming composition comprises (ii) from about 0.03 to about 0.08 weight percent of the dye.

20. The method of claim 1, wherein need for a separate manufacturing operation of immersing a preformed hydrophilic polymer in an aqueous solution of reactive dye, is eliminated.

21. A method for tinting a hydrophilic polymer which comprises:

a) subjecting a hydrophilic polymer-forming composition comprising (i) at least one hydrophilic ethylenically unsaturated monomer, (ii) a reactive dye and (iii) a polymerization initiator which does not chemically affect the reactive dye to polymer forming conditions to provide a hydrophilic polymer in which the reactive dye is substantially uniformly incorporated therein; and, b) contacting the polymer with an aqueous solution of a base which catalyzes the reaction between the polymer and the reactive dye, the reactive dye thereby becoming covalently bound to the polymer;

wherein the aqueous solution of the base is heated to at least about 50° C.

22. The method of claim 21 wherein the aqueous solution of the base is heated to at least about 80° C.

23. A method for tinting a hydrophilic polymer which comprises:

a) subjecting a hydrophilic polymer-forming composition comprising (i) at least one hydrophilic ethylenically unsaturated monomer, (ii) a reactive dye and (iii) a polymerization initiator which does not chemically affect the reactive dye to polymer forming conditions to provide a hydrophilic polymer in which the reaction dye is substantially uniformly incorporated therein; and, b) contacting the polymer with an aqueous solution of a base which catalyzes the reaction between the polymer and the reactive dye, the reactive dye thereby becoming covalently bound to the polymer;

wherein (iii) the polymerization initiator is other than a peroxide-type polymerization initiator.

24. The method of claim 23 wherein (iii) the polymerization initiator is a photoinitiator.

25. The method of claim 24 wherein the polymer-forming composition comprises (iii) from about 0.25 to about 1.0 percent of the photo-initiator.

26. The method of claim 24 wherein (iii) the photoinitiator is selected from the group consisting of benzoin methyl ether, 2,2-azobis(2,4-dimethylvaleronitrile) and 2,2-azobis(2,4-dimethyl-4-methoxyvaleronitrile).

* * * * *

UNITED STATES PATENT AND TRADEMARK OFFICE

CERTIFICATE OF CORRECTION

PATENT NO. : 5,151,106

DATED : September 29, 1992

INVENTOR(S) : Bhaumik et al.

It is certified that error appears in the above-identified patent and that said Letters Patent is hereby corrected as shown below:

Column 7, line 29, change "w-as" to --was--; and

Column 7, line 30, insert a period between "11" and "2".

Signed and Sealed this

Twelfth Day of October, 1993

*Attest:*

*Attesting Officer*

Bruce Lehman

BRUCE LEHMAN

*Commissioner of Patents and Trademarks*